US009456272B2

(12) United States Patent
Lee et al.

(10) Patent No.: US 9,456,272 B2
(45) Date of Patent: Sep. 27, 2016

(54) BUTTON-PRESS DETECTION AND FILTERING

(71) Applicant: Fairchild Semiconductor Corporation, San Jose, CA (US)

(72) Inventors: Tony Cheng Han Lee, South Portland, ME (US); Shawn Kirk Barden, Gorham, ME (US); Ricky Li, Beijing (CN); Emma Wang, Beijing (CN)

(73) Assignee: Fairchild Semiconductor Corporation, San Jose, CA (US)

( * ) Notice: Subject to any disclaimer, the term of this patent is extended or adjusted under 35 U.S.C. 154(b) by 536 days.

(21) Appl. No.: 13/852,812

(22) Filed: Mar. 28, 2013

(65) Prior Publication Data

US 2013/0259269 A1 Oct. 3, 2013

(30) Foreign Application Priority Data

Mar. 30, 2012 (CN) ..... 2012 1 0099872

(51) Int. Cl.
*H04R 3/00* (2006.01)
*H04R 1/10* (2006.01)

(52) U.S. Cl.
CPC ..... *H04R 3/00* (2013.01); *H04R 1/1041* (2013.01); *H04R 2410/00* (2013.01)

(58) Field of Classification Search
CPC ... H04R 3/00; H04R 2410/00; H04R 1/1041
See application file for complete search history.

(56) References Cited

U.S. PATENT DOCUMENTS

2004/0008129 A1* 1/2004 Philipp ..... 341/22
2006/0068771 A1 3/2006 Lou
2007/0296712 A1* 12/2007 Li ..... G06F 3/0362 345/184
2008/0059197 A1* 3/2008 Jones et al. ..... 704/270.1
2008/0143671 A1* 6/2008 Li ..... G06F 3/023 345/156
2010/0081488 A1* 4/2010 Kim ..... 455/575.2

FOREIGN PATENT DOCUMENTS

| | | | |
|---|---|---|---|
| CN | 200956611 | Y | 10/2007 |
| CN | 101102337 | A | 1/2008 |
| CN | 101493728 | A | 7/2009 |
| CN | 201584957 | U | 9/2010 |
| CN | 102053224 | A | 5/2011 |
| CN | 202600109 | U | 12/2012 |

OTHER PUBLICATIONS

"Chinese Application Serial No. 201210099872.9, First Office Action mailed Apr. 29, 2015", w/ English Translation, 10 pgs.

* cited by examiner

*Primary Examiner* — Ping Lee
(74) *Attorney, Agent, or Firm* — Schwegman Lundberg & Woessner, P.A.

(57) ABSTRACT

The disclosure provides a button-press detection and filtering method, related circuit, and button-press detection chip for a external device. A button-press signal from a wire control apparatus is coupled to the button-press detection chip for the external device. The button-press detection chip for the external device can digitally sample the button-press signal through the filter circuit and outputs a digital logic signal corresponding to a button to an audio codec according to the sampling result. The audio codec can determine a pressed button according to the digital logic signal and performs a corresponding function. With the solutions of the disclosure, a noise interference signal in a button-press signal may be avoided and a pressed button may be accurately detected, without using a dedicated chip or complex software codes in a wire control apparatus and an electronic device.

17 Claims, 4 Drawing Sheets

BUTTON-PRESS DETECTION AND FILTERING

CLAIM OF PRIORITY

This application claims the benefit of priority to Chinese Patent Application Serial No. 201210099872.9, filed on Mar. 30, 2012, which is incorporated by reference herein in its entirety.

BACKGROUND

With the rapid development of portable electronic devices, wire control apparatuses have been developed that can enable users to conveniently operate the electronic devices from an external device, such as a wire control apparatus. For example, users can implement control of music playing, answer a call, control volume, and so on using said external device.

Some buttons are generally provided on the wire control apparatuses to implement different control functions, and the electronic devices identify that a certain button is pressed through the detection of a button-press signal. However, in practical applications, the button-press signal generally contains noise interference signals. In order to accurately perform button-press detection and avoid failure and omission of button-press detection due to the noise interference signals, in normal cases, a customized button-press signal transmitting chip are required on the wire control apparatus with a matching button-press signal receiving chip on the electronic device.

As shown in FIG. 1, a mobile device, such as the iPod® from Apple Inc., can be provided with a wire control handset. The wire control handset is includes a dedicated digital signal transmitting chip IC1 configured to identify a pressed button and generate a corresponding digital signal. Similarly, the mobile device can include a dedicated digital signal receiving chip IC2 configured to receive the digital signal and transmit the digital signal to an audio codec 32 as a control signal. The audio codec 32 can control a left sound channel signal (L_SPKR) and a right sound channel signal (R_SPKR) transmitted to the wire control handset according to a control signal. Failure or omission of button-press detection due to noise interference signals can be avoided using the dedicated digital signal transmitting and receiving chips IC1, IC2, but the dedicated chips need to be arranged on both the wire control apparatus and the electronic device, which greatly increases the manufacturing cost.

In addition, failure or omission of button-press detection due to noise interference signals can be avoided by filtering the button-press signal using software, but the filtering requires complex software codes, which increases the processing capacity of codes of an operating system of the electronic device and is not beneficial to the product design.

In certain applications, passgates can be employed to pass a signal between two nodes of an electronic device. For example, a passgate can be used to pass a signal from an electronic device, such as a portable electronic device, to an accessory device connected to the electronic device. Passgates can be used to pass analog signals, such as analog audio signals, between devices. Design criteria for passgate control circuits can influence how well a passgate can pass certain analog signals without introducing distortion and how well a passgate can isolate the two nodes when the passgate is not enabled. Some analog passgates and corresponding passgate controls are made using high-voltage processes such that the passgate and control circuits can withstand reception of higher voltage signals. Such high-voltage devices and processes to make such devices can add costs to products using such devices.

OVERVIEW

In view of the above, in order to solve the problem in the prior art that the noise interference signals included in the button-press signals need to be eliminated by using a dedicated chip or complex software codes, a button-press detection and filtering method, a related circuit, and a button-press detection chip for an external device is provided.

A filter circuit can be configured to digitally sample a button-press signal, to determine a pressed button according to the sampling result, and to output a digital logic signal corresponding to the pressed button. A button-press detection chip for an external device can include a filter circuit, a digital logic circuit, and an Inter-Integrated Circuit (I2C) bus. The filter circuit can be configured to digitally sample the button-press signal, to determine the pressed button according to the sampling result, and to output the digital logic signal corresponding to the pressed button to the digital logic circuit. The digital logic circuit is configured to receive the digital logic signal output by the filter circuit, and to transmit the digital logic signal to an audio codec through the I2C bus.

A button-press detection circuit can include a button-press detection chip for an external device and an audio codec. The button-press detection chip for the external device can be configured to receive a button-press signal from a wire control apparatus, to digitally sample the button-press signal through a filter circuit, and to output a digital logic signal corresponding to a pressed button to the audio codec according to the sampling result. The audio codec can be configured to determine a pressed button according to the digital logic signal and to perform a corresponding function.

A button-press detection method can include coupling a button-press signal of a wire control apparatus to a button-press detection chip for an external device. The button-press detection chip for the external device can digitally sample the button-press signal through the filter circuit and can output a digital logic signal corresponding to a button to an audio codec according to the sampling result. The audio codec can determine a pressed button according to the digital logic signal and perform a corresponding function.

A button-press signal filtering method can include digitally sampling a button-press signal from a wire control apparatus to determine the pressed button according to the sampling result and outputting a digital logic signal corresponding to the pressed button.

In an example, a wire control apparatus can be coupled to a button-press detection chip of an electronic device. The button-press detection chip can digitally sample a button-press signal through a filter circuit and can output a digital logic signal, corresponding to a button, to an audio codec according to the sampling result. The audio codec can determine a pressed button according to the digital logic signal and can perform a corresponding function. Further, a filter circuit can be integrated in the button-press detection chip in an external device, which can save spaces on the printed circuit board, reduce the manufacturing cost, and facilitate the product design of the electronic device.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A wire control apparatus can be coupled to a button-press detection chip for an external device of an electronic device. The button-press detection chip for the external device can digitally sample a button-press signal through a filter circuit and can output a digital logic signal, corresponding to a button, to an audio codec according to the sampling result. The audio codec can determine a pressed button according to the digital logic signal and can performing a corresponding function.

Figure 1:
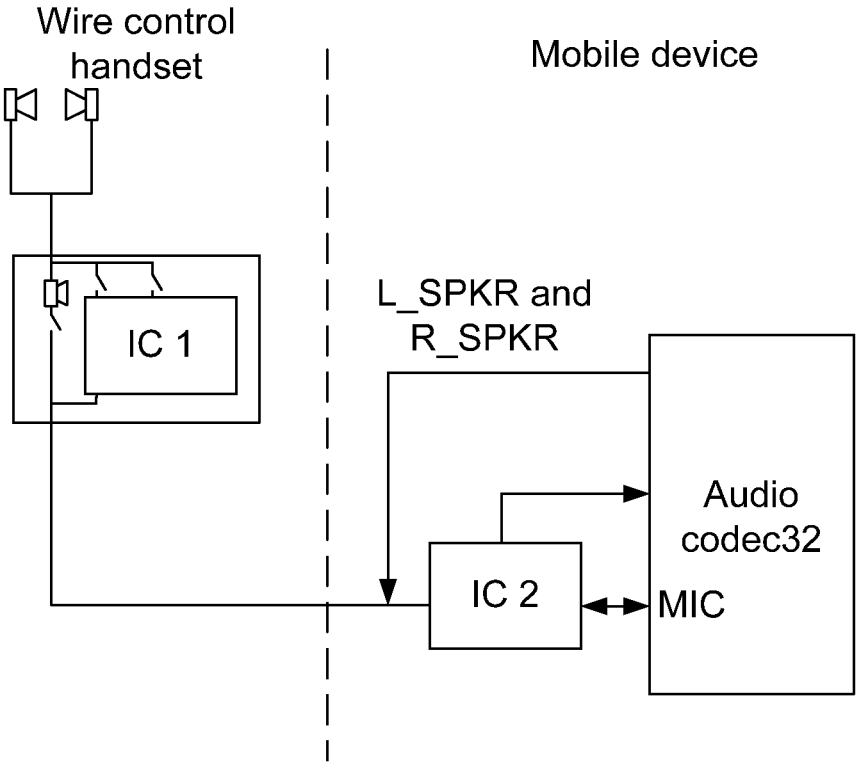
FIG. 1 is a schematic view of a button-press detection circuit for a wire control handset in the prior art.
Figure 2:
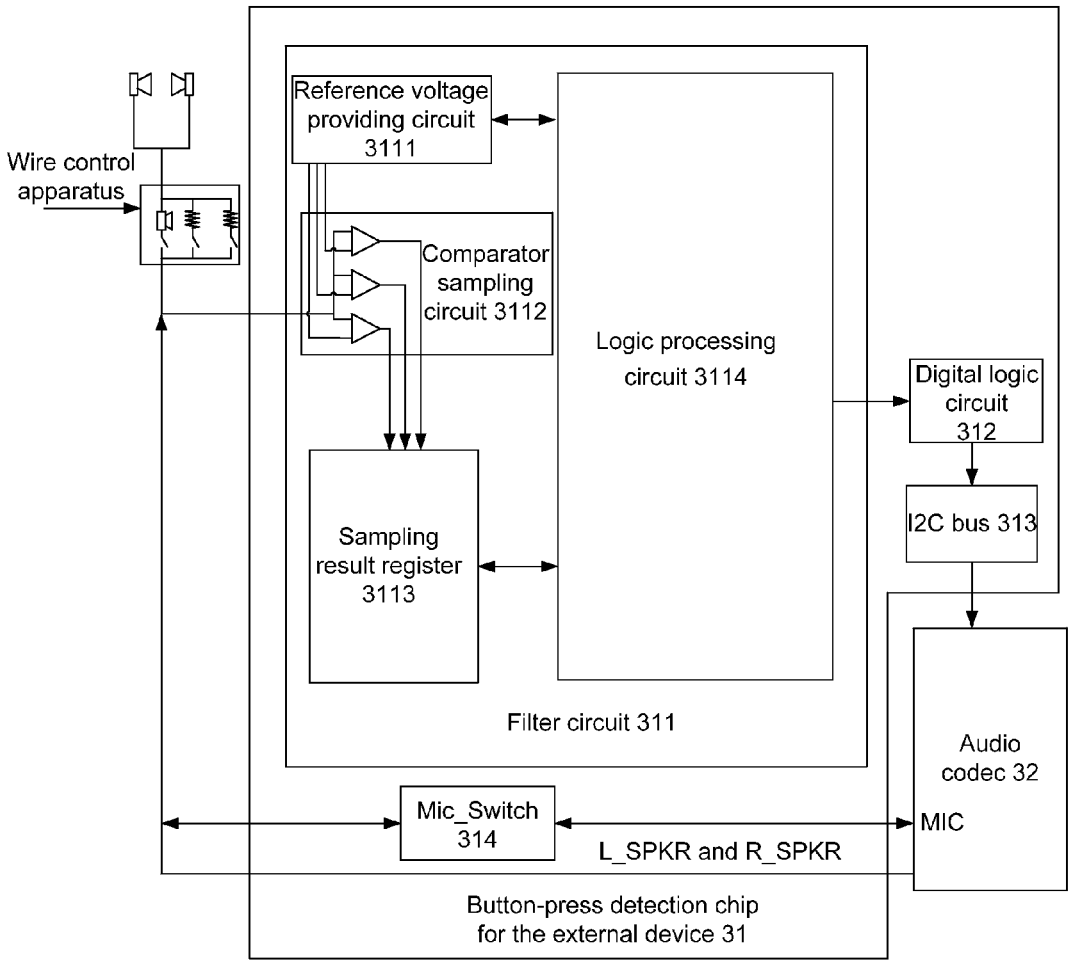
FIG. 2 is a schematic view of a button-press detection circuit implemented by an embodiment of the disclosure.

FIG. 2 is a schematic view of a button-press detection circuit implemented by an embodiment of the disclosure including a button-press detection chip 31 for an external device and an audio codec 32. The button-press detection chip 31 for the external device is configured to receive a button-press signal from a wire control apparatus, to digitally sample the button-press signal through a filter circuit, and to output a digital logic signal corresponding to a button to the audio codec 32 according to the sampling result.

The audio codec 32, in FIG. 2, is configured to determine a pressed button according to the digital logic signal, and perform a corresponding function. The button-press detection chip 31 for the external device includes a filter circuit 311, a digital logic circuit 312, and an I2C bus 313. The filter circuit 311 is configured to digitally sample the button-press signal, to determine the pressed button according to the sampling result, and to output the digital logic signal corresponding to the pressed button to the digital logic circuit 312. The digital logic circuit 312 is configured to receive the digital logic signal output by the filter circuit, and to transmit the digital logic signal to the audio codec 32 through the I2C bus 313.

In this example, the button-press detection chip 31 for the external device further includes a microphone switch (Mic_Switch) 314, configured to transmit an audio signal to the audio codec 32 when a microphone button is pressed. The filter circuit 311 includes a reference voltage providing circuit 3111, a comparator sampling circuit 3112, a sampling result register 3113, and a logic processing circuit 3114. The reference voltage providing circuit 3111 is configured to provide reference voltages of one or more buttons to the comparator sampling circuit 3112. The comparator sampling circuit 3112 is provided with one or more comparators, e.g., of which the number equal to the number of the buttons, wherein each of the comparators compares a reference voltage of a respective button with a voltage of a respective button-press signal, and one or more of the comparators triggered by the respective button-press signals transmit respective trigger signals to the sampling result register 3113.

Specifically, in the comparator sampling circuit 3112 of the example of FIG. 2, the reference voltage of each of the buttons is coupled to a first signal input of a respective one of the comparators, each of the button-press signals is coupled to a second signal input of a respective one of the comparators, and an output of each of the comparators is coupled to the sampling result register 3113.

The sampling result register 3113 in the example of FIG. 2 is configured to receive the respective trigger signals output by the one or more of the comparators in the comparator sampling circuit 3112, to count, at each of output ports, through a respective pulse counter, according to the triggering of the one or more of the comparators, and to transmit the count result at each of the output ports to the logic processing circuit 3114. The logic processing circuit 3114 is configured to determine the pressed button according to the count result at each of the output ports, and to output the digital logic signal corresponding to the pressed button.

Specifically, in the example of FIG. 2, the logic processing circuit 3114 inquires an output port at which the count result first reaches a preset threshold, determines the button corresponding to the output port as the pressed button, and outputs the digital logic signal corresponding to the pressed button.

Operational principles of the comparator sampling circuit 3112, the sampling result register 3113, and the logic processing circuit 3114 will be further described by way of specific examples hereinafter.

When there are three buttons which need detection in the wire control apparatus, three comparators are provided in the comparator sampling circuit 3112.

Figure 3:
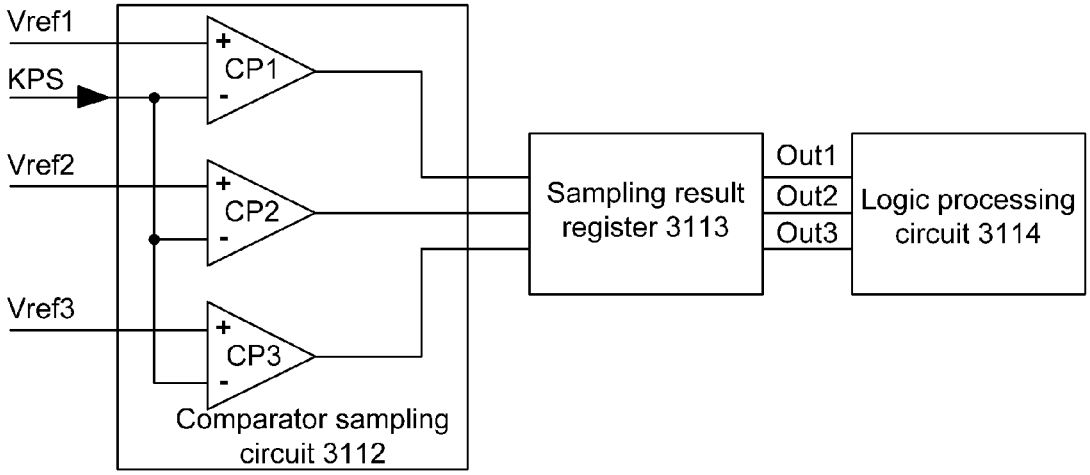
FIG. 3 is a schematic view of a filter circuit when there are three buttons which need detection in a wired-controller according to an embodiment of the disclosure.

FIG. 3 is a schematic view of a filter circuit when there are three buttons which need detection in a wired-controller according to an embodiment of the disclosure. In FIG. 3, the positive inputs of the three comparators receive reference voltages of the three buttons, respectively. A reference voltage Vref1 of a first button is received at a positive input of a first comparator CP1, a reference voltage Vref2 of a second button is received at a positive input of a second comparator CP2, and a reference voltage Vref3 of a third button is received at a positive input of a third comparator CP3, assuming that Vref1 is lower than Vref2 and Vref2 is lower than Vref3. Button-press signals KPS are received at negative inputs of the three comparators. When a voltage of KPS is lower than Vref1, all the comparators are triggered and generate trigger signals at a high level to the sampling result register 3113, which increments the count value of an impulse counter at a first output port Out1 by 1.

When the voltage of KPS is greater than Vref1 and lower than Vref2, the first comparator CP1 is not triggered, the second and third comparators CP2 and CP3 are triggered and generate trigger signals at a high level to the sampling result register 3113, which increments the count value of an impulse counter at a second output port Out2 by 1. When the voltage of KPS is greater than Vref2 and lower than Vref3, the first and second comparators CP1 and CP2 are not triggered, the third comparator CP3 is triggered and generates a trigger signal at a high level to the sampling result register 3113, which increments the count value of an impulse counter at a second output port Out3 by 1. When a count result of the pulse counter at the first output port Out1 first reaches a preset threshold, it is determined that the first button is pressed, and the digital logic circuit 3114 outputs a digital logic signal (for example, 01) corresponding to the first button. When a count result of the pulse counter at the second output port Out2 first reaches the preset threshold, it is determined that the second button is pressed, and the digital logic circuit 3114 outputs a digital logic signal (for example, 10) corresponding to the second button. When a count result of the pulse counter at the third output port Out3 first reaches the preset threshold, it is determined that the third button is pressed, and the digital logic circuit 3114 outputs a digital logic signal corresponding to the third button. The preset threshold can be set according to a sampling rate and sampling time of a chip in which the filter circuit is located. For example, the threshold may be 10, 28 and 30, etc. The larger the threshold is, the higher the precision of the button-press detection is.

Figure 4:
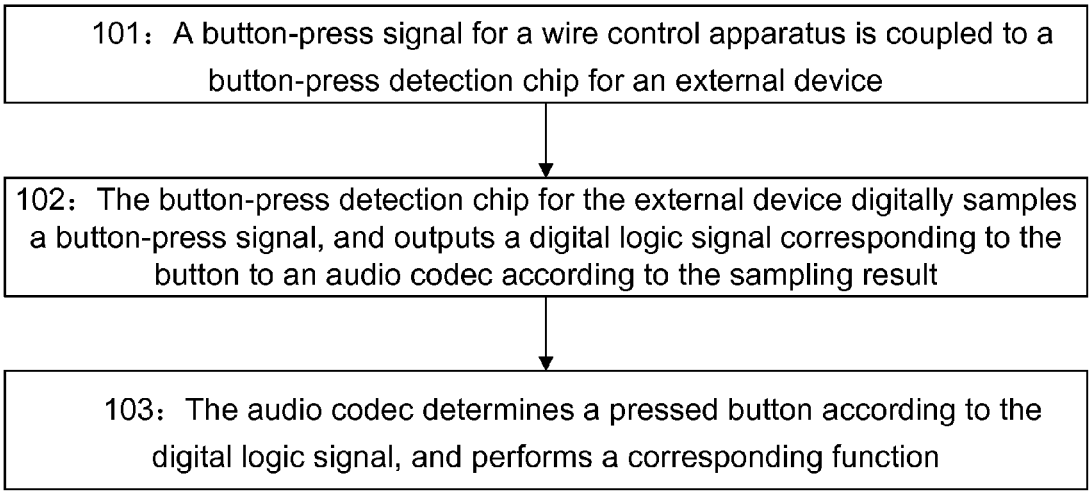
FIG. 4 is a flowchart of a button-press detection method implemented by an embodiment of the disclosure.

FIG. 4 is a flowchart of a button-press detection method implemented by an embodiment of the disclosure. At 101, the wire control apparatus is coupled to a button-press detection chip for an external device of an electronic device. Here, the button-press detection chip for the external device includes a multi-button detection chip for an audio interface.

At 102, the button-press detection chip for the external device digitally samples the button-press signal through the filter circuit and outputs a digital logic signal corresponding to a button to an audio codec according to the sampling result.

Specifically, the filter circuit is integrated in the button-press detection chip for the external device, one or more comparators, of which the number is equal to the number of buttons, are provided in the filter circuit, a reference voltage of each of the buttons is received at a first signal input of a respective one of the comparators, a button-press signal is received at a second signal input of each of the comparators, one or more trigger signals are generated when one or more of the comparators are triggered by their respective button-press signals, each pulse counter counts at a respective output port according to the triggering of the one or more of the comparators and the filter circuit determines the pressed button according to the count result at each of the output ports, and digital logic signals corresponding to the respective buttons are output to the digital logic circuit in the button-press detection chip for the external device. The digital logic circuit transmits the digital logic signals to the audio codec through an Inter-Integrated Circuit (I2C).

The filter circuit determines the pressed button according to the count result at each of the output ports specifically by inquiring an output port at which the count result first reaches a preset threshold, and determining the button corresponding to the output port as the pressed button.

The implementation of the step will be further described by way of specific examples hereinafter.

In the case that there is only one button which needs detection in the wire control apparatus, one comparator is provided in the filter circuit, a reference voltage of the button is received at a positive input of the comparator, and a button-press signal is received at a negative input of the comparator, wherein when a voltage of the button-press signal at the negative input is lower than the reference voltage at the positive input, the comparator is triggered and generates a trigger signal at a high level, a pulse counter counts at an output port until a count result reaches a preset threshold, then it is determined that the button is pressed, a digital logic signal (for example, 11) corresponding to the button is output, and the digital logic circuit in the button-press detection chip for the external device transmits the digital logic signal to the audio codec through the I2C bus. The preset threshold can be set according to a sampling rate and sampling time of a chip in which the filter circuit is located. For example, the threshold may be 10, 28 and 30, etc. The larger the threshold is, the higher the precision of the button-press detection is.

In the case that there are two buttons which need detection in the wire control apparatus, two comparators are provided in the filter circuit, reference voltages of the two buttons are received at positive inputs of the two comparators, respectively, wherein the first comparator receives a reference voltage Vref1 of the first button, the second comparator receives a reference voltage Vref2 of the second button, the values of the Vref1 and Vref2 are determined by the resistances serially connected to the first and second buttons. Here, it is assumed that Vref1 is lower than Vref2. Button-press signals are received at negative inputs of the two comparators, wherein when a voltage of the button-press signal is lower than Vref1, both the comparators are triggered and generate trigger signals at a high level, and a pulse counter at a first output port is incremented by 1. When the voltage of the button-press signal is greater than Vref1 and lower than Vref2, the first comparator is not triggered, the second comparator is triggered and generates a trigger signal at a high level, and a pulse counter at a second output port is incremented by 1. When a count result of the pulse counter at the first output port first reaches a preset threshold, it is determined that the first button is pressed, and a digital logic signal (for example, 01) corresponding to the first button is output. When a count result of the pulse counter at the second output port first reaches the preset threshold, it is determined that the second button is pressed, and a digital logic signal (for example, 10) corresponding to the second button is output. The digital logic circuit in the button-press detection chip for the external device transmits the digital logic signal to the audio codec through the I2C bus. The preset threshold is usually set according to a sampling rate and sampling time of a chip in which the filter circuit is located. For example, the threshold may be 10, 28 and 30, etc. The larger the threshold is, the higher the precision of the button-press detection is.

In the case that there are three buttons which need detection in a wire control apparatus, three comparators are provided in the filter circuit, reference voltages of the three buttons are received at positive inputs of the three comparators, respectively, wherein, a reference voltage Vref1 of the first button is received at a positive input of the first comparator, a reference voltage Vref2 of the second button is received at a positive input of the second comparator, a reference voltage Vref3 of the third button is received at a positive input of the third comparator, and the values of the Vref1, Vref2 and Vref3 are determined by the resistances serially connected to the first, second and third buttons. Here, it is assumed that Vref1 is lower than Vref2, and Vref2 is lower than Vref3. Button-press signals are received at negative inputs of the three comparators, wherein when a voltage of the button-press signal is lower than Vref1, all the comparators are triggered and generate trigger signals at a high level, and a pulse counter at a first output port is incremented by 1. When the voltage of the button-press signal is greater than Vref1 and lower than Vref2, the first comparator is not triggered, the second and third comparators are triggered and generate trigger signals at a high level, and a pulse counter at a second output port is incremented by 1. When the voltage of the button-press signal is greater than Vref2 and lower than Vref3, the first and second comparators are not triggered, the third comparator is triggered and generates a trigger signal at a high level, and a pulse counter at a third output port is incremented by 1. When a count result of the pulse counter at the first output port first reaches a preset threshold, it is determined that the first button is pressed, and a digital logic signal (for example, 01) corresponding to the first button is output. When a count result of the pulse counter at the second output port first reaches the preset threshold, it is determined that the second button is pressed, and a digital logic signal (for example, 10) corresponding to the second button is output; and when a count result of the pulse counter at the third output port first reaches the preset threshold, it is determined that the third button is pressed, and a digital logic signal (for example, 11) corresponding to the third button is output; and the digital logic circuit in the button-press detection chip for the external device transmits the digital logic signal to the audio codec through the I2C bus. The preset threshold is usually set according to a sampling rate and sampling time of a chip in which the filter circuit is located. For example, the threshold may be 10, 28 and 30, etc. The larger the threshold is, the higher the precision of the button-press detection is.

When there are more than three buttons which need detection in the wire control apparatus, the manner of operation of the filter circuit is similar to that above.

At 103, the audio codec determines a pressed button according to the digital logic signal and performs a corresponding function.

The embodiment of the disclosure provides a button-press signal filtering method, including digitally sampling a button-press signal from a wire control apparatus, determining the pressed button according to the sampling result, and outputting a digital logic signal corresponding to the pressed button.

The method further includes arranging one or more comparators, of which the number is equal to the number of buttons, receiving a reference voltage of each of the buttons at a first signal input of a respective one of the comparators, receiving a button-press signal at a second signal input of each of the comparators, wherein the digitally sampling the button-press signal, determining the pressed button according to the sampling result, and outputting the digital logic signal corresponding to the pressed button includes each of the comparators compares a reference voltage of a respective button with a voltage of a respective button-press signal, wherein one or more of the comparators triggered by their respective button-press signals generate trigger signals; each pulse counter counts at a respective output port according to the triggering of the one or more of the comparators and the pressed button is determined according to the count result at each of the output ports, and the digital logic signal corresponding to the pressed button is output.

The determining the pressed button according to the count result at each of the output ports includes inquiring an output port at which the count result first reaches a preset threshold and determining the button corresponding to the output port as the pressed button.

With the solution provided the disclosure, a noise interference signal in a button-press signal may be avoided and a pressed button may be accurately detected, without using a dedicated chip or complex software codes in a wire control apparatus and an electronic device. Additionally, a filter circuit is integrated in the button-press detection chip for the external device, which can save spaces on the printed circuit board, reduce the manufacturing cost, and facilitate the product design.

Additional Notes

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. In other examples, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A button-press detection circuit, comprising:

a filter circuit configured to digitally sample a button-press signal from a button on a wire-control apparatus of an external device, to determine a pressed button on the wire-control apparatus using the digital sample, and to provide a digital logic signal to cause an audio codec to perform a function corresponding to the pressed button, wherein the filter circuit includes:

a comparator sampling circuit configured to compare a reference voltage to a voltage of the button-press signal;

a sampling result register having a sampling rate, the sampling result register configured to receive an output of the comparator sampling circuit and to provide a count result using the output of the comparator sampling circuit and the sampling rate; and a logic processing circuit configured to determine the pressed button according to the count result and to output the digital logic signal corresponding to the pressed button.

2. The circuit of claim 1, wherein a reference voltage providing circuit is configured to provide the comparator sampling circuit with reference voltages of more than one button;

wherein the comparator sampling circuit is provided with a number of comparators equal to a number of the buttons, wherein each of the comparators compares a reference voltage of a respective button with a voltage of a respective button-press signal, and one or more of the comparators triggered by the respective button-press signals send respective trigger signals to the sampling result register;

wherein the sampling result register is configured to receive the respective trigger signals output by the one or more of the comparators in the comparator sampling circuit, to count, at each of output ports, through a respective pulse counter, according to the triggering of the one or more of the comparators, and to transmit the count result at each of the output ports to the logic processing circuit; and wherein the logic processing circuit is configured to determine the pressed button according to the count result at each of the output ports, and to output the digital logic signal corresponding to the pressed button.

3. The circuit of claim 2, wherein, in the comparator sampling circuit, the reference voltage of each of the buttons is coupled to a first signal input of a respective one of the comparators, each of the button-press signals is coupled to a second signal input of a respective one of the comparators, and an output of each of the comparators is coupled to the sampling result register.

4. The circuit of claim 1, including:

a button-press detection chip for detecting a button-press signal from an external device, including:

the filter circuit;

a digital logic circuit; and an Inter-Integrated Circuit (I2C) bus;

wherein the filter circuit is configured to output a digital logic signal corresponding to the pressed button to the digital logic circuit; and wherein the digital logic circuit is configured to receive the digital logic signal output by the filter circuit, and to transmit the digital logic signal to an audio codec through the I2C bus.

5. The circuit of claim 4, including:

a microphone switch configured to transmit an audio signal to the audio codec when a microphone button is pressed.

6. The circuit of claim 1, including:

a button-press detection chip for an external device, including the filter circuit; and an audio codec;

wherein the button-press detection chip for the external device is configured to receive a button-press signal from a wire control apparatus, to digitally sample the button-press signal through the filter circuit, and to output a digital logic signal corresponding to a pressed button to the audio codec according to the sampling result; and wherein the audio codec is configured to determine the pressed button according to the digital logic signal and to perform a corresponding function.

7. The circuit of claim 1, wherein the logic processing circuit is configured to determine the pressed button by comparing the count result to a threshold, wherein the threshold is greater than 10.

8. The circuit of claim 1, wherein the sampling result register has a sampling time, and wherein the sampling result register is configured to provide the count result using the output of the comparator sampling circuit, the sampling rate, and the sampling time.

9. A method, comprising:

digitally sampling a button-press signal from a button on a wire-control apparatus of an external device using a filter circuit of a button-press detection circuit, the digitally sampling including:

comparing a reference voltage to a voltage of the button-press signal using a comparator sampling circuit; and providing a count result using an output of the comparing sampling circuit and a sampling rate;

determining a pressed button on the wire-control apparatus using a logic processing circuit according to the count result; and providing a digital logic signal to cause an audio codec to perform a function corresponding to the pressed button using the logic processing circuit.

10. The method of claim 9, wherein the outputting the digital logic signal includes to n audio codec.

11. The method of claim 9, including:

performing a function according to the pressed button.

12. The method of claim 9, wherein the button-press signal includes information from multiple buttons.

13. The method of claim 12, wherein the determining the pressed button includes determining which of the multiple buttons have been pressed.

14. The method of claim 9, including:

receiving a reference voltage;

comparing the reference voltage to a voltage of the button-press signal;

receiving an output of the comparing and providing a count result; and wherein the determining the pressed button includes according to the count result.

15. The method of claim 14, including:

receiving a reference voltage for each button associated with the button-press signal;

comparing each reference voltage to the button-press information for each button associated with the button-press signal;

generating a trigger signal for each of the comparisons;

counting the trigger signals;

wherein the determining the pressed button includes according to the count result associated with each of the comparisons; and transmitting the digital logic signal through an Inter-Integrated Circuit (I2C).

16. The method of claim 9, wherein the determining the pressed button includes comparing the count result to a threshold, wherein the threshold is greater than 10.

17. The method of claim 9, wherein the providing the count result includes using the output of the comparing sampling circuit, the sampling rate and a sampling time.

* * * * *